US007818987B2

(12) United States Patent
Marshall

(10) Patent No.: US 7,818,987 B2
(45) Date of Patent: Oct. 26, 2010

(54) METHOD AND APPARATUS FOR TRIMMING A CAN

(75) Inventor: Harold James Marshall, Forest, VA (US)

(73) Assignee: Belvac Production Machinery, Inc., Lynchburg, VA (US)

( * ) Notice: Subject to any disclaimer, the term of this patent is extended or adjusted under 35 U.S.C. 154(b) by 675 days.

(21) Appl. No.: 11/581,787

(22) Filed: Oct. 17, 2006

(65) Prior Publication Data

US 2007/0227320 A1 Oct. 4, 2007

Related U.S. Application Data

(60) Provisional application No. 60/787,502, filed on Mar. 31, 2006.

(51) Int. Cl.

| | |
|---|---|
| ***B21D 51/26*** | (2006.01) |
| ***B21D 28/00*** | (2006.01) |
| ***B21D 51/02*** | (2006.01) |
| ***B21J 11/00*** | (2006.01) |
| ***B26D 5/00*** | (2006.01) |

(52) U.S. Cl. ..... 72/94; 72/340; 72/405.03; 72/715; 72/379.4; 83/946

(58) Field of Classification Search ..... 72/379.4, 72/715, 94, 340, 405.03; 82/53; 83/114, 83/115, 945, 946, 923, 914
See application file for complete search history.

(56) References Cited

U.S. PATENT DOCUMENTS

| | | | |
|---|---|---|---|
| 1,621,301 | A | 1/1927 | Wright |
| 2,346,376 | A | 4/1944 | Heavener |
| 2,686,551 | A | 8/1954 | Laxo |
| 2,928,454 | A | 3/1960 | Laxo |
| 3,096,709 | A | 7/1963 | Eldred et al. |
| 3,621,530 | A | 11/1971 | Pflieger et al. |
| 3,983,729 | A | 10/1976 | Traczyk et al. |
| 4,030,432 | A | 6/1977 | Miller et al. |
| 4,102,168 | A | 7/1978 | Brookes et al. |
| 4,513,595 | A | 4/1985 | Cvacho |
| 4,697,691 | A | 10/1987 | Zodrow et al. |

(Continued)

FOREIGN PATENT DOCUMENTS

| | | |
|---|---|---|
| CA | 2 536 841 | 3/2005 |

(Continued)

OTHER PUBLICATIONS

U.S. Appl. No. 11/643,934, filed Dec. 22, 2006, Shortridge.

(Continued)

*Primary Examiner*—Dana Ross
*Assistant Examiner*—Mohammad Yusuf
(74) *Attorney, Agent, or Firm*—Foley & Lardner LLP

(57) ABSTRACT

A trimming turret including a first trimmer head including a first pilot. The turret is configured to receive a stress induced plastically deformed container having earing about a respective opening in the container, and at least one of (i) direct the container to the first trimmer head so that the pilot becomes located inside the opening, and (ii) direct the first trimmer head to the container so that the pilot becomes located inside the opening. The turret is configured to trim off the earing from the container with the first trimmer head.

24 Claims, 12 Drawing Sheets

U.S. PATENT DOCUMENTS

| | | | | |
|---|---|---|---|---|
| 4,892,184 | A | 1/1990 | Vander Griendt et al. | |
| 5,704,240 | A | 1/1998 | Jordan | |
| 5,762,174 | A | 6/1998 | Risley et al. | |
| 6,050,396 | A | 4/2000 | Moore | |
| 6,055,836 | A | 5/2000 | Waterworth et al. | |
| 6,176,006 | B1 | 1/2001 | Milliman et al. | |
| 6,199,420 | B1 | 3/2001 | Bartosch | |
| 6,233,993 | B1 | 5/2001 | Irie | |
| 6,378,695 | B1 | 4/2002 | Rinne | |
| 6,467,322 | B2 | 10/2002 | Nogami et al. | |
| 6,644,083 | B2 | 11/2003 | Pakker | |
| 6,672,122 | B2 | 1/2004 | Mustread et al. | |
| 6,779,651 | B1 | 8/2004 | Linglet et al. | |
| 2005/0193796 | A1 | 9/2005 | Heiberger et al. | |
| 2007/0017089 | A1 * | 1/2007 | Hosoi | 29/801 |

FOREIGN PATENT DOCUMENTS

| | | | |
|---|---|---|---|
| DE | 1 939 623 | | 2/1970 |
| DE | 101 56 085 | | 5/2003 |
| FR | 2 881 123 | | 7/2006 |
| GB | 07306 | | 3/1898 |
| JP | 2002-102968 | | 4/2002 |
| JP | 2003-237752 | | 8/2003 |
| JP | 2003-251424 | | 9/2003 |
| JP | 2003-252321 | | 9/2003 |
| JP | 2003-320432 | | 11/2003 |
| JP | 2004-002557 | | 1/2004 |
| JP | 2004-130386 | | 4/2004 |
| JP | 2004-160468 | | 6/2004 |
| JP | 2004-217305 | | 8/2004 |
| JP | 2005-022663 | | 1/2005 |
| JP | 2006-176140 | | 7/2006 |
| JP | 2006-176183 | | 7/2006 |
| WO | WO-94/12412 | | 6/1994 |
| WO | WO-96/33032 | | 10/1996 |
| WO | WO-97/37786 | | 10/1997 |
| WO | WO-97/49509 | | 12/1997 |
| WO | WO2005/023450 | * | 3/2005 |
| WO | WO-2006/067901 | | 6/2006 |

OTHER PUBLICATIONS

U.S. Appl. No. 11/643,935, filed Dec. 22, 2006, Shortridge et al.
U.S. Appl. No. 11/643,950, filed Dec. 22, 2006, Marshall et al.
U.S. Appl. No. 11/692,564, filed Mar. 28, 2007, Marshall et al.
U.S. Appl. No. 11/692,584, filed Mar. 28, 2007, Schill et al.
USPTO Final Office Action dated Mar. 2, 2010 received in the related application of U.S. Appl. No. 11/643,935, filed Dec. 22, 2006 in the name of Jeffrey L. Shortridge.
Office action dated Mar. 10, 2010 received in related U.S. Appl. No. 11/692,584.

* cited by examiner

METHOD AND APPARATUS FOR TRIMMING A CAN

CROSS-REFERENCE TO RELATED PATENT APPLICATIONS

This application is an application claiming the benefit under 35 USC 119(e) of U.S. Provisional Patent Application Ser. No. 60/787,502, filed on Mar. 31, 2006, by inventors Harold James Marshall et al., entitled Assemblies and Components of a Machine Line, the contents of which are incorporated herein by reference in their entirety.

BACKGROUND OF THE INVENTION

As detailed in the above-referenced U.S. Provisional Patent Application (Ser. No. 60/787,502), a process (utilized by the employer of the present inventor(s)) is utilized to neck a can, such as an aluminum can, or other stress-induced plastically deformable container. That is, a process exists where a diameter of an opening is reduced in size by drawing-out or lengthening (necking) the area of the container proximate the opening.

As a can (or other container) is necked, the opening takes on a waviness in shape (instead of being level and circular). The "wavy" portion of the container is referred to as "earing" (which is a condition caused by the continuous forming or necking of the container). Typically, the smaller the openings of the can with respect to its original size, the more reductions or necking operations that are required, and the wavier the top edge of a can becomes. Typically, the waviness is not a desirable feature, and, in fact, can cause various problems with subsequent can production operations, such as, for example, edge rolling and/or threading.

SUMMARY OF THE INVENTION

The present inventors have developed a trimming device and process to remove the above-discussed earing produced during their necking process. In one embodiment of the present invention, a trimming operation utilizing a trimmer of the inventors' own design is performed following a given number of necking operations. By way of example, after a can has gone through, for example, five, six or seven necking operations, the waviness/earing are trimmed from the can and then in some embodiments, the can is then subjected to further necking after which a trimmer is again applied to the can to remove the waviness/earing that were produced from the second set of necking. While the just described scenario results in two trimming operations between the two necking operations, depending on the type of can, the can size, the type of material the can is made out of, etc., more or less trimming operations may be required.

DETAILED DESCRIPTION OF THE PREFERRED EMBODIMENTS

A trimming device according to the present invention may be a separate machine or the trimming device may be one machine in a machine line. Before discussing the specifics of the trimming device according to the present invention, a brief description of a machine line according to an embodiment of the present invention will be briefly described.

In an exemplary machine line, as is detailed in U.S. Provisional Patent Application No. 60/787,502 (referenced above) an article, such as an embryonic aluminum can, is first fed into a first machine to fill stations in a turret/star wheel. Each star wheel may have any number of stations to hold articles for processing or transfer. For example, a star wheel may have six, eight or ten stations to hold six, eight or ten articles, respectively. It will be recognized that the star wheel is capable of having one station to any suitable number of stations.

The article is then processed through any number of stages, one or more of which may be a necking stage, and one or more of which may be a trimming stage. When all process/forming stages are complete, the article is discharged from the machine. The machine line may be a recirculating machine line or any other type of machine line (see, e.g., U.S. Provisional Patent Application No. 60/787,502 (referenced above)).

In one exemplary scenario, after the first set of necking operations and the first trimming operation in a trimming turret of a trimming device according to the present invention (described below in greater detail), the article (e.g., can) is recirculated by the recirculating machine back to the beginning to be subjected to further necking operations in a "second pass" (the first set of necking and trimming being done in the "first pass"), as described above. That is, after the cans are loaded in a primary end feed, the cans come into the machine that will go through the first pass tooling and be subjected to, for example, 17 reductions (the can is necked 17 times), and then the cans go up the recirculating conveyor and then come back and are loaded in the second pass pockets on the trimming turret. (In some embodiments, the cans go through exactly the same turrets, but are subjected to a different set of tooling in the turret for the second pass, as will be discussed in greater detail below.)

In some embodiments of the invention, there is a trimmer immediately at the end of the "necker" tooling which trims after the first pass, wherein the trimmer then also trims after the second pass, in the same turret. This allows for two different opening diameters to be trimmed within one trimming turret.

It is noted that in other embodiments of the trimmer invention, there is also a trimming turret after a threading turret that imparts threads onto a can, which is used to trim the can after the threads are imparted onto the can.

Various aspects of the trimmer device, which may be utilized in the line just described, will now be discussed.

Figure 1:
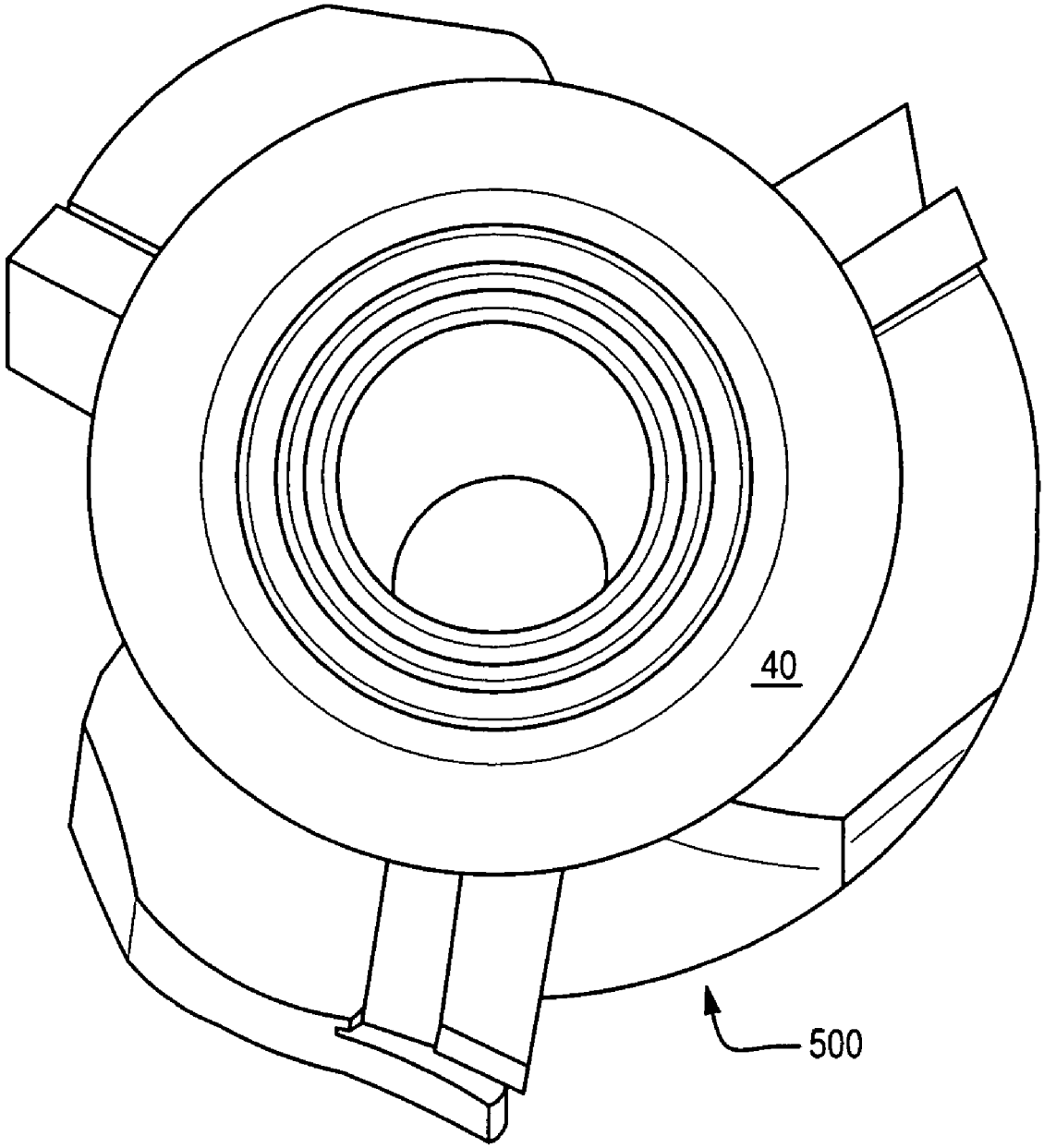
FIG. 1 is a depiction of a trimmer head according to an embodiment of the present invention.
Figure 2A:
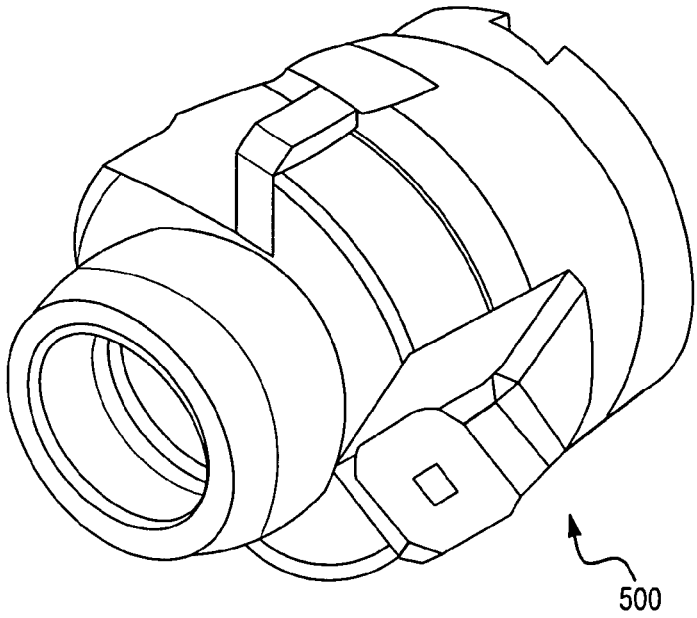
FIGS. 2A-2C are schematic representations of the trimmer head of FIG. 1
Figure 2B:
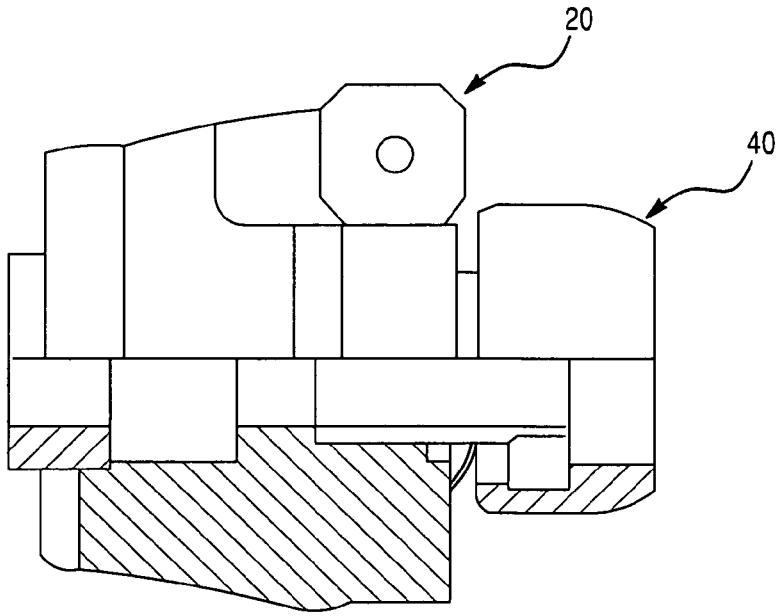
Figure 2C:
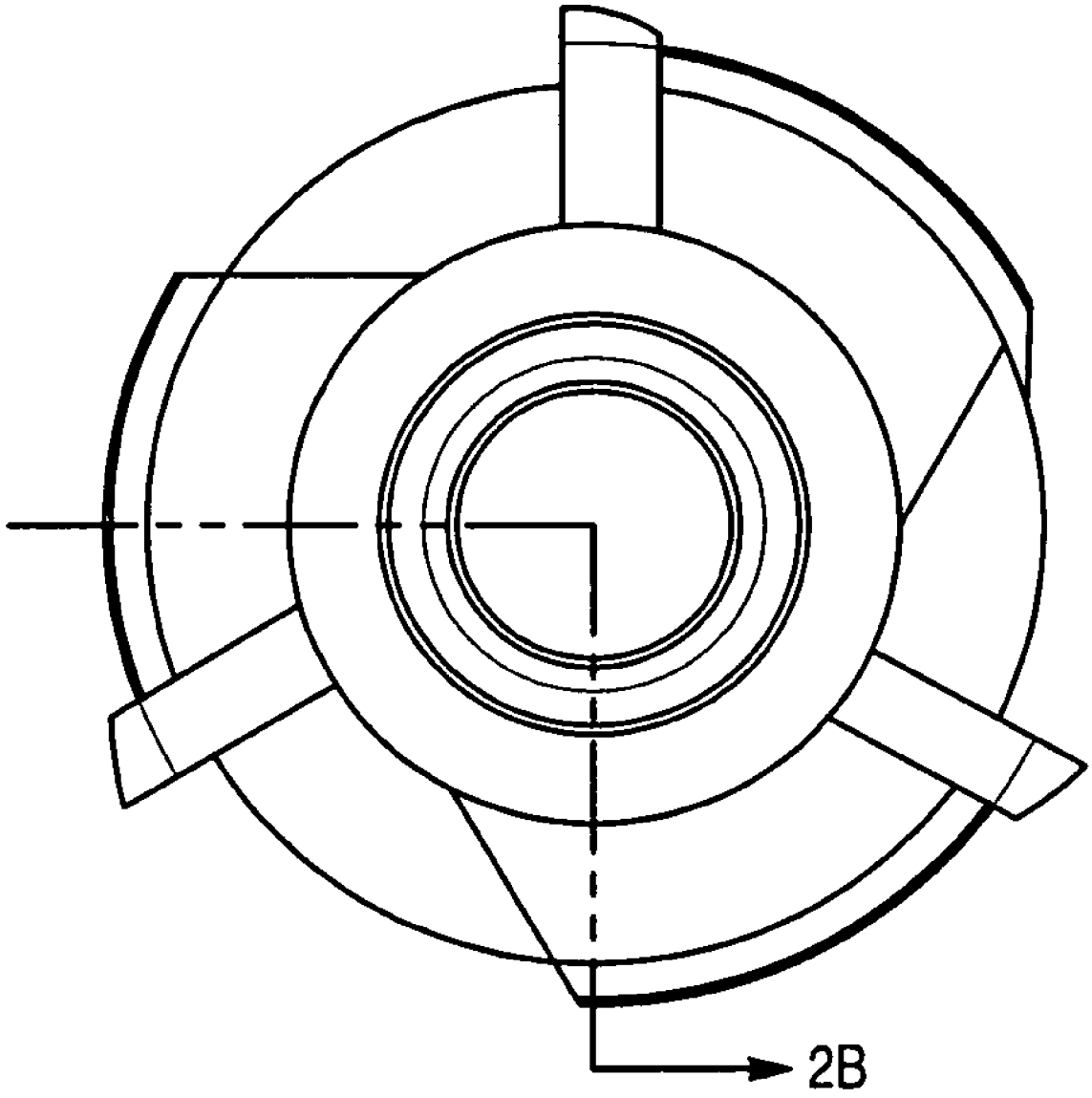
Figure 3A:
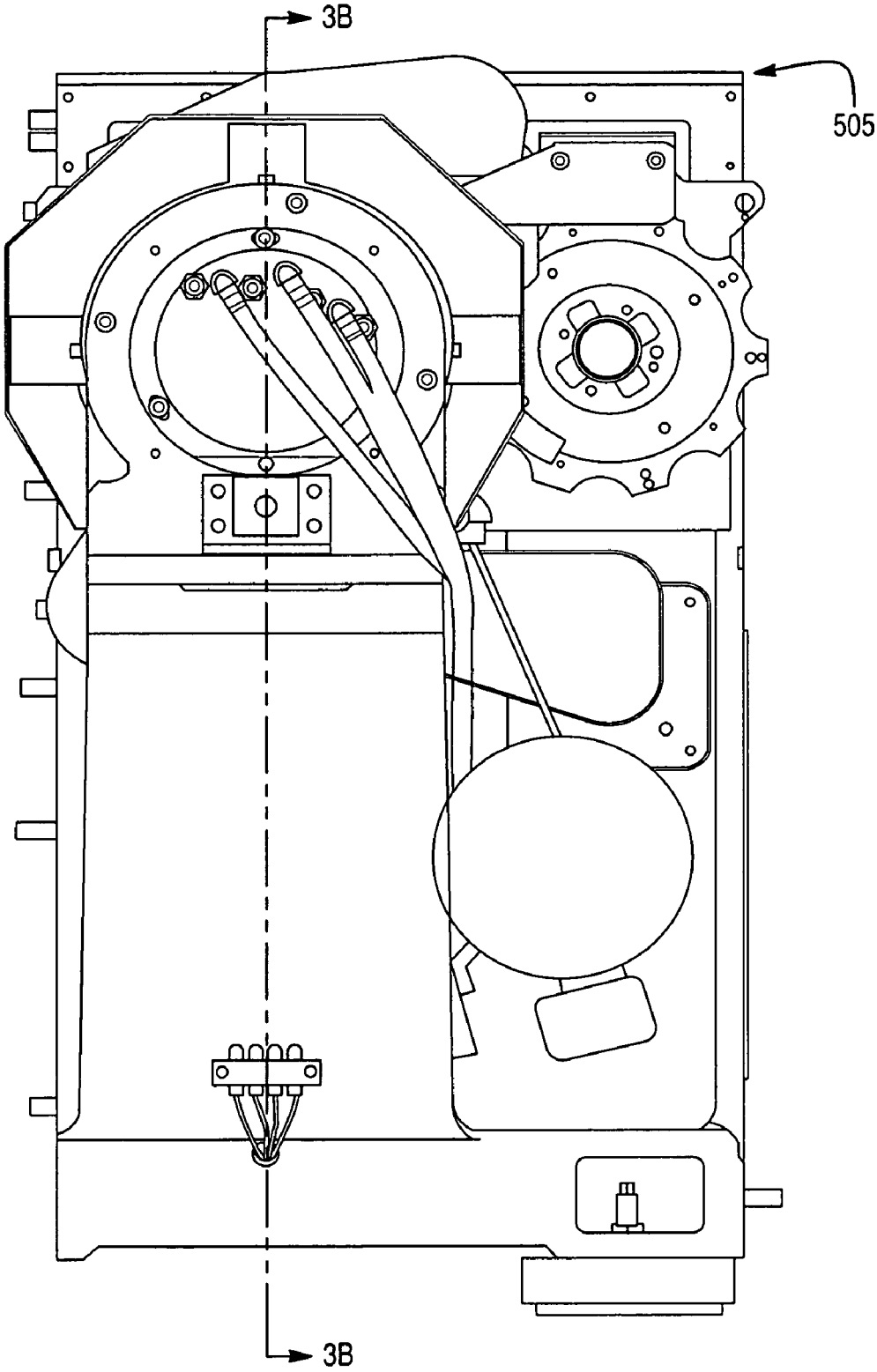
FIG. 3A depicts a side-view of a trimmer machine according to an embodiment of the present invention.
Figure 3B:
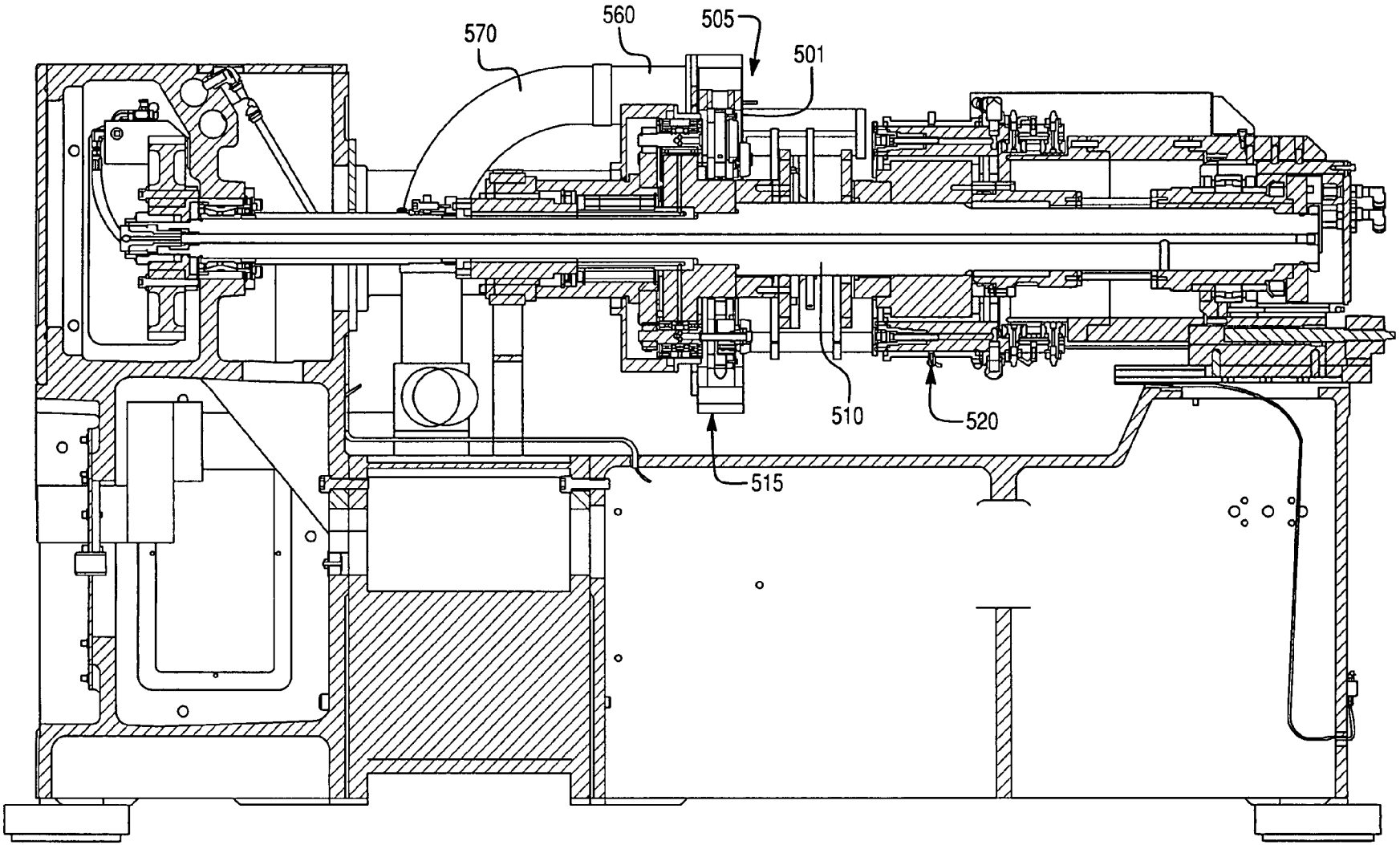
FIG. 3B depicts a cross-sectional view of a trimmer machine of FIG. 3A, wherein a trimmer turret may be seen.
Figure 4A:
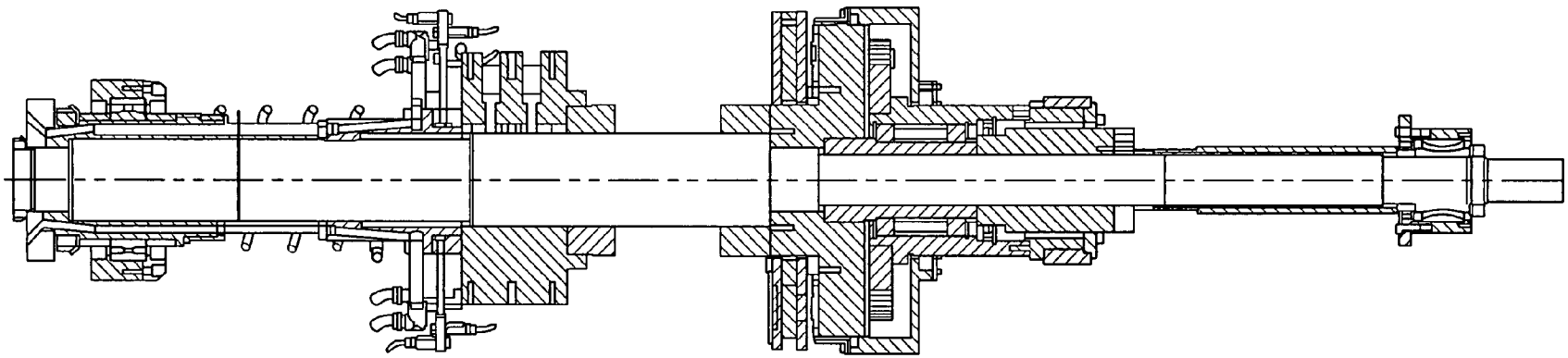
FIGS. 4A-C depict cross-sectional views of a trimmer turret according to the present invention.
Figure 4B:
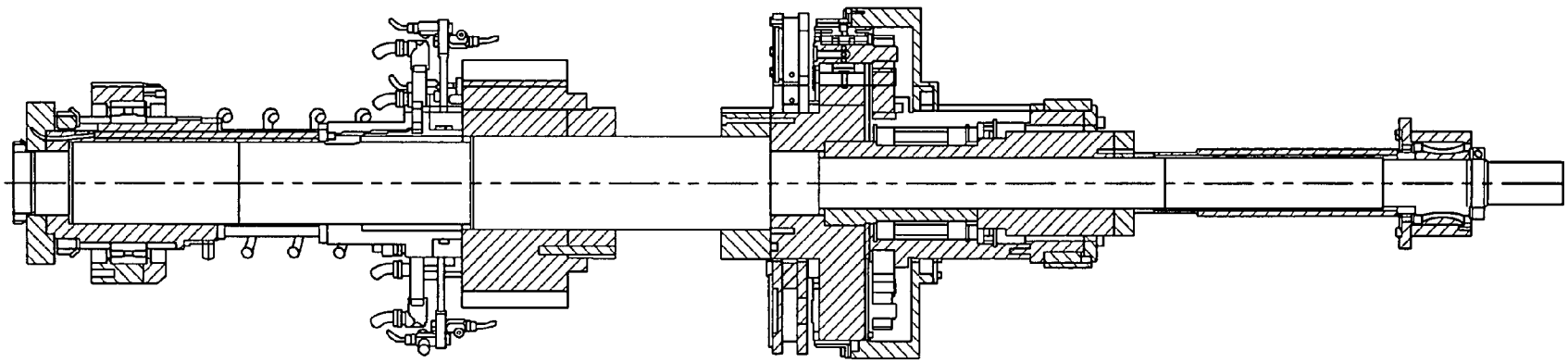
Figure 4C:
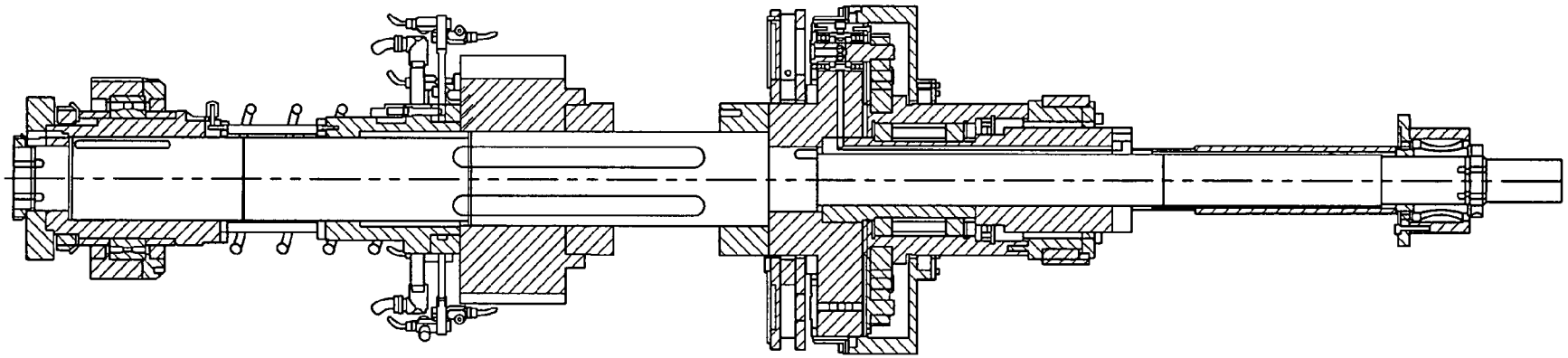
Figure 5A:
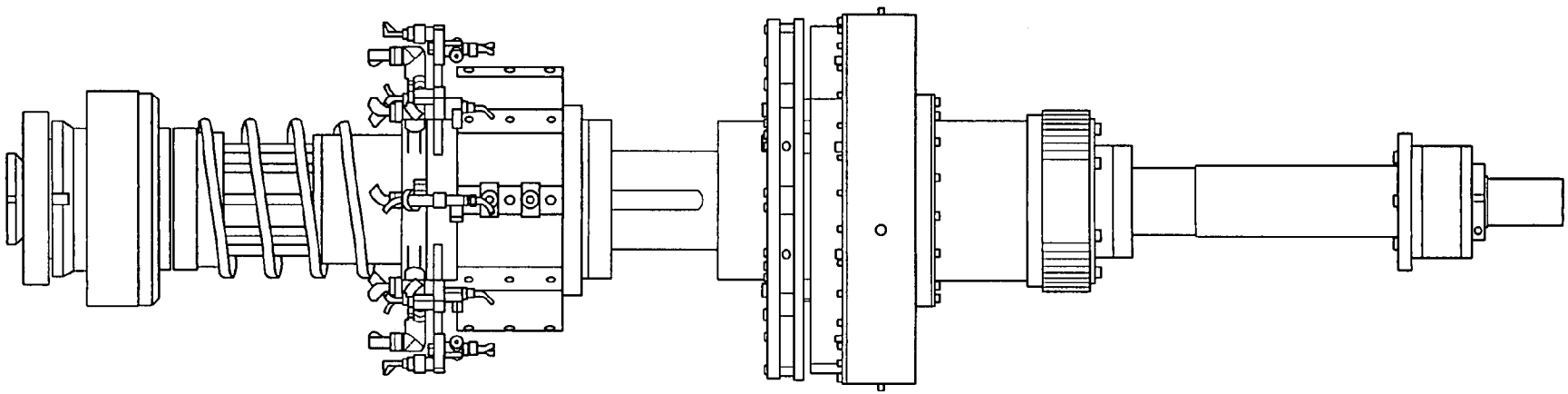
FIGS. 5A-5D depict various views of a trimmer turret according to the present invention.
Figure 5B:
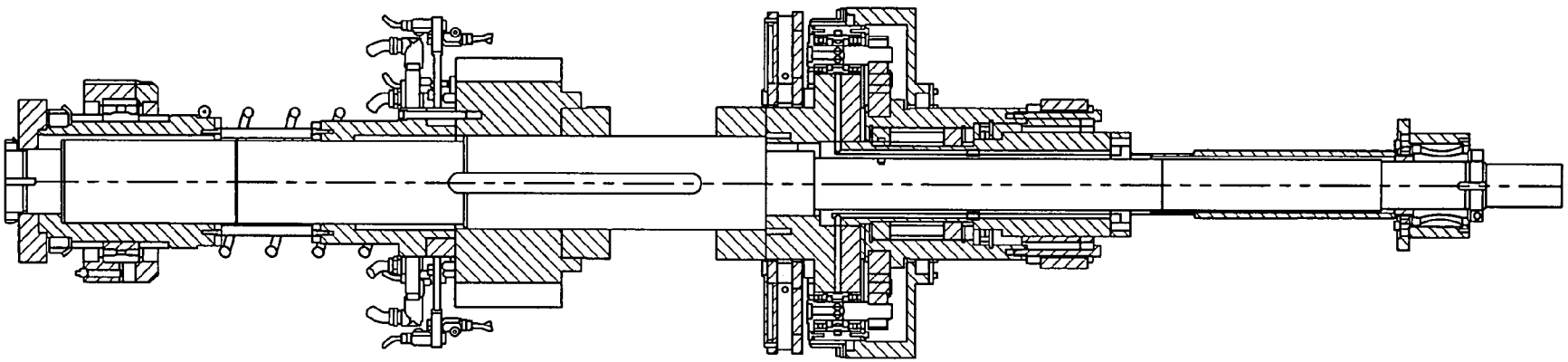
Figure 5C:
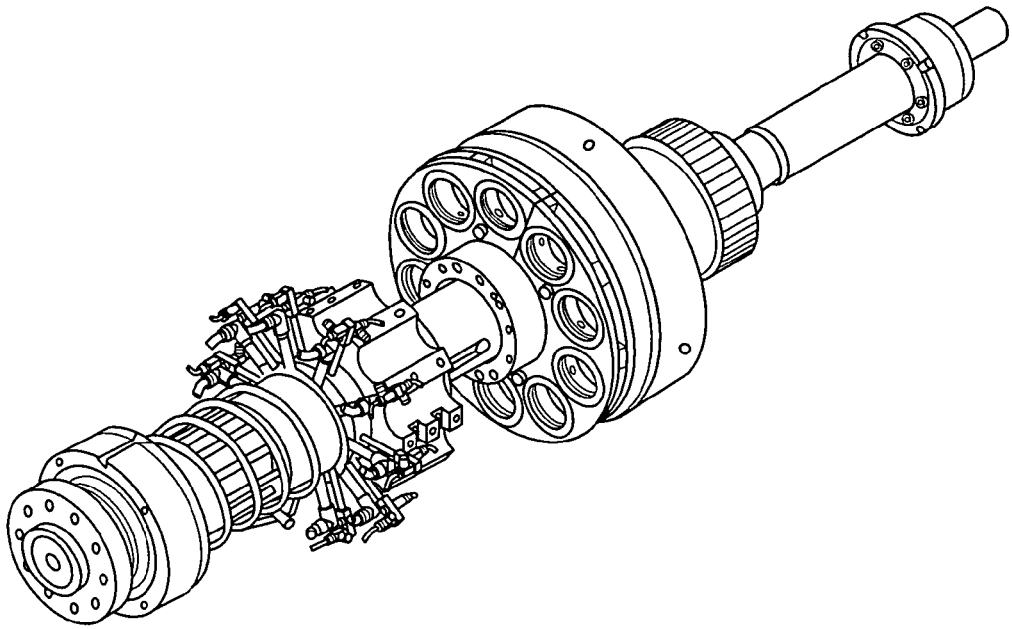
Figure 5D:
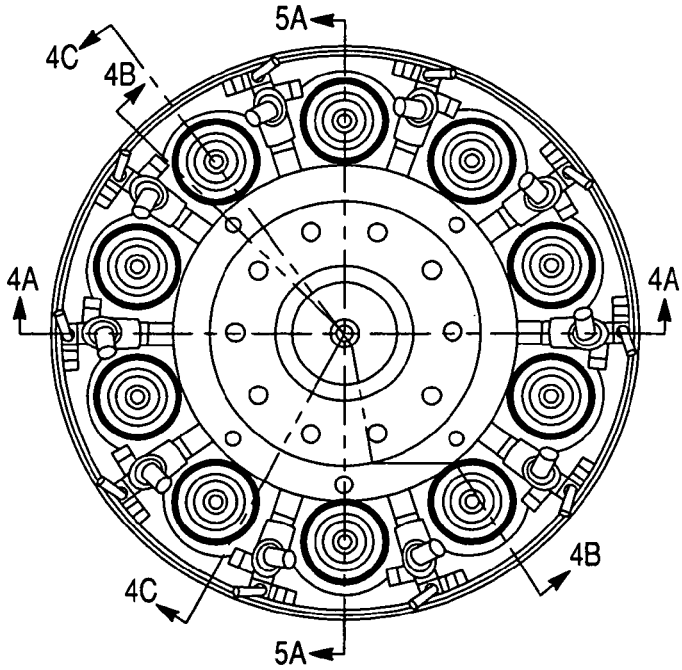
Figure 6:
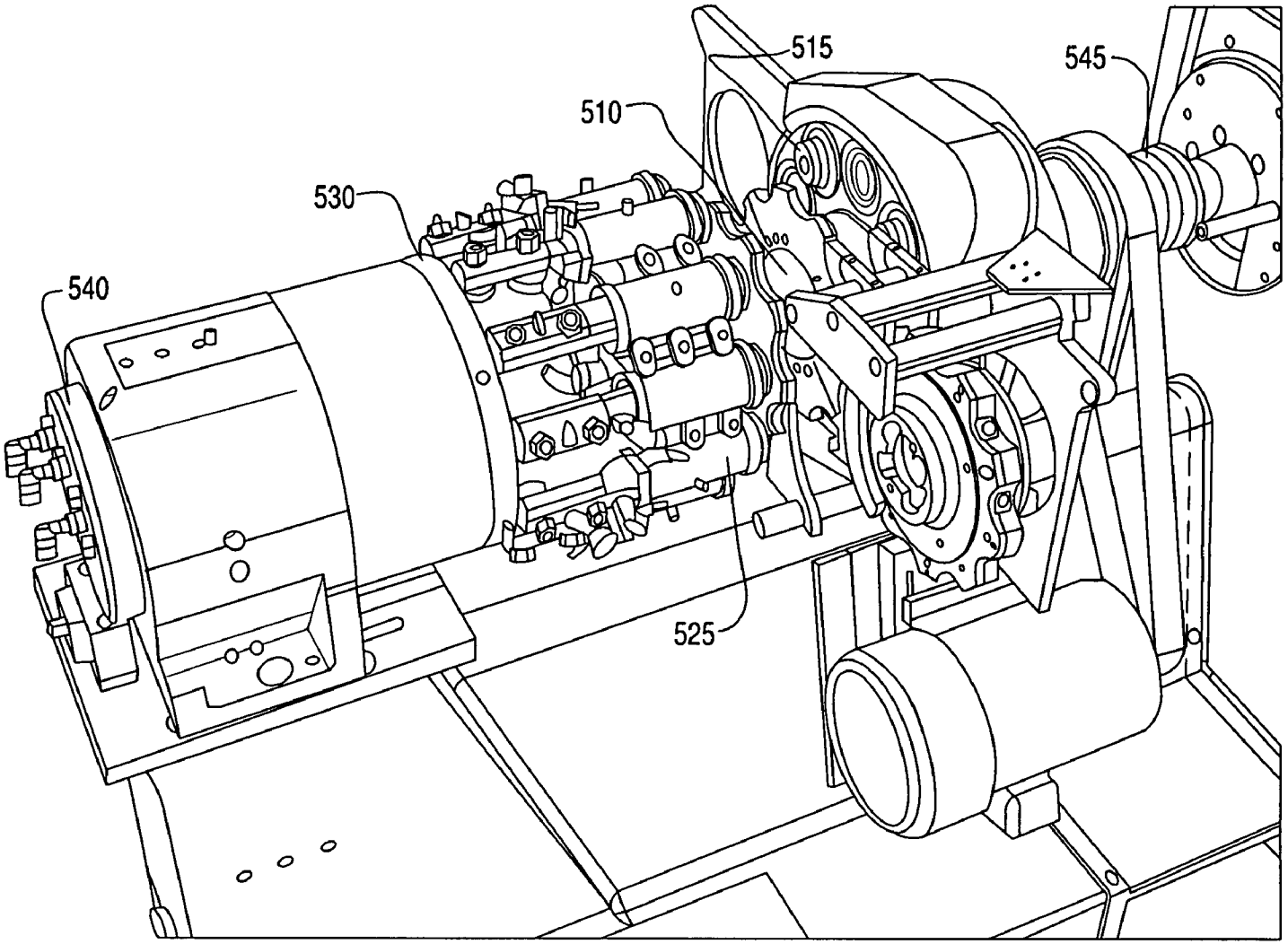
FIG. 6 depicts an isometric view of a trimmer machine according to an embodiment of the present invention.
Figure 7:
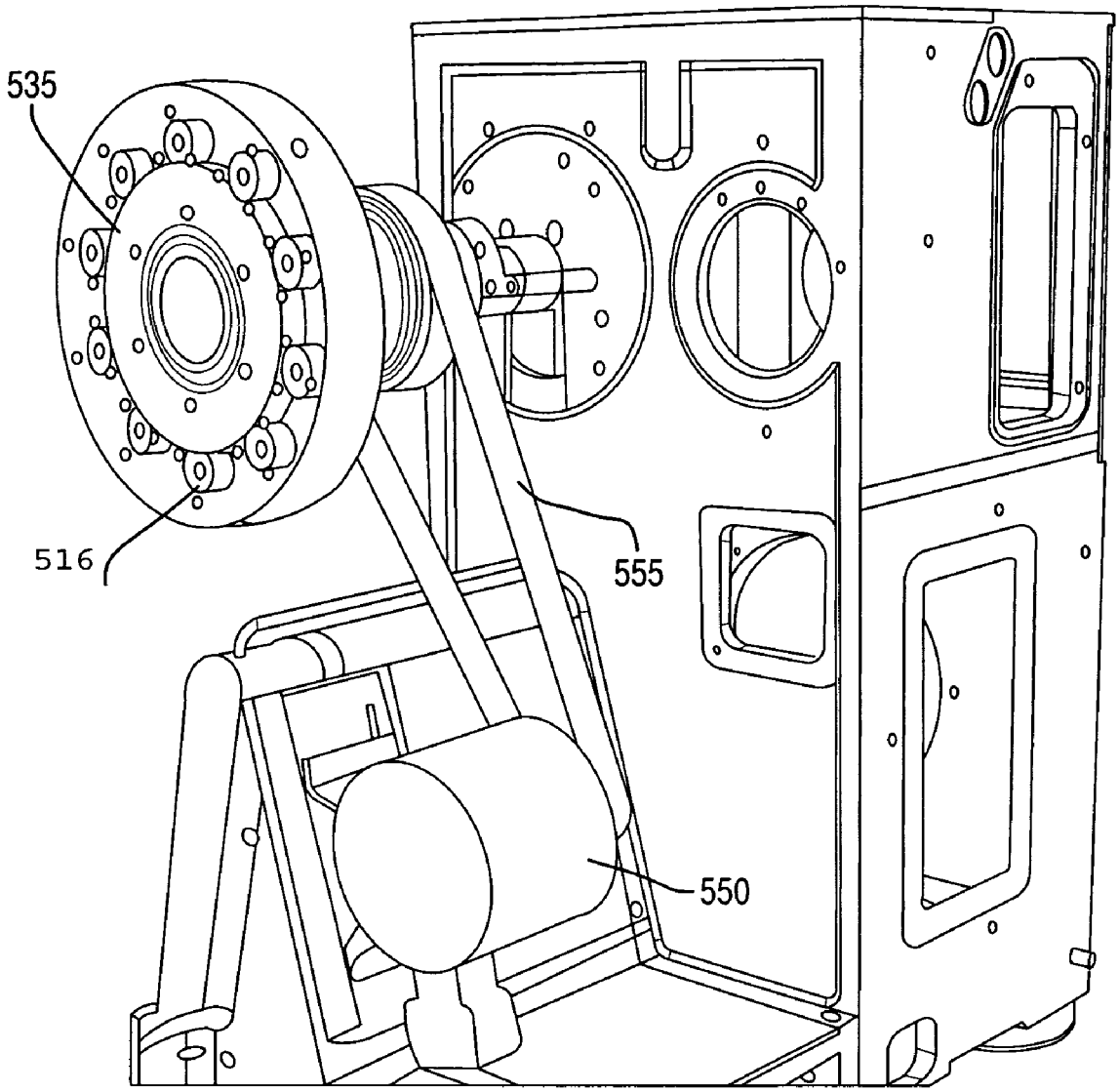
FIG. 7 depicts an isometric view of a portion of the trimmer machine according to an embodiment of the present invention.

In a first embodiment of the present invention, there is a trimmer head 500 as may be seen in FIGS. 1-2C. Trimmer head 500 includes blade inserts 20 which are mounted onto a cutter chassis 30. The blade inserts 20 are designed to be replaceable with respect to the body of the trimmer head 500. By way of example only and not by way of limitation, a hex bolt or other type of bolt or other attachment means may be used to attach the blades to the body of the trimmer 500 such that the blades may be replaced as the blades become worn through use.

The trimmer head 500 also includes a trimmer pilot. FIGS. 1-2C depict the trimmer pilot 40. In some embodiments of the present invention, the outer diameter and the dimensions of the pilot 40 are sized such that the trimmer head 500 may be roughly centered with respect to the opening of the bottle or can during trimming of the wavy portion/earing. That is, the pilot 40, in some embodiments, is of different sizes for different trimmers 500. In particular, referring to the above multi-series necking scenario, a pilot having a larger outer diameter would be utilized on a trimmer 500 for trimming bottles/cans that have undergone the first series of necking operations, but would not be used for the second series of operations, because the opening at the top of the bottle/can would be larger after the first pass than the opening of the bottle/can after the next series of necking operations, whether in a second pass or later in the line. Accordingly, after the second set of necking operations is completed, and the diameter of the neck is smaller than after the first series of operations, a trimmer head 500 with a pilot having a smaller outside diameter is utilized to interface with the now smaller opening of the bottle. These two configurations of trimmer heads may be arrayed on a single turret, in sets of five, for example, to trim the cans during recirculation.

Accordingly, various size pilots may be utilized with the trimmer head 500 according to the present invention based on the size of the opening of the can in which the waviness/earing are to be removed.

As to the structure of the trimming portion (i.e., the milling portion, which herein means the trimmer head 500 irrespective of the pilot) of the trimmer head 500, in some embodiments of the present invention, the trimmer head 500 utilizes a standard milling head that may be used, for example, to "hog out" a piece of aluminum. Of course, the milling head would be sized to be compatible with the general size of the can/bottle that is being trimmed, but in some embodiments, the same milling head (albeit with the appropriate size pilots) may be utilized to trim the can/bottle after the various necking operations. That is, by way of example only, referring to the above scenario, the same milling body design that is used to trim the necked can/bottle after the first series of necking operations may be used to trim the can/bottle after the second series of necking operations, the difference in the trimmer heads 500 used in the two operations being the size of the pilot. However, in other embodiments of the present invention, a different sized milling head may be utilized as well. In some embodiments, any size milling head, along with the properly sized pilot combined with that milling head, may be utilized to practice some embodiments of the present invention, providing that the waviness/earing may be efficiently and satisfactorily removed.

In some embodiments of the present invention, the trimmer heads 500 are mounted in a trimming turret 501 of a trimming machine 505, such as that shown, by way of example only, in FIGS. 3-7. On the trimming turret 501 depicted in these figures, there are 10 locations for active trimmer heads (not shown), of which 5 are used in the first pass and the other five are used in a second pass, in an alternating manner, wherein the 5 used in the first pass have pilots with diameters greater than the pilots of the heads used in the second pass. (In other embodiments, 12 or more or 8 or less locations are present on the trimmer turret—an even number of locations being used on many embodiments to allow for two pass execution.)

In some embodiments, the trimming turret 501 may include a main shaft 510, a housing with multiple trimming spindles 515 (which in some embodiments are configured to move towards a can, thus constituting a means for directing the trimmer device to the container so that the pilot becomes located inside the opening), a housing 520 with multiple push ram assemblies 525 (which in some embodiments is a means for directing the container to the trimmer device so that the pilot becomes located inside the opening), a cam 530 to actuate the push rams, a driven gear 535 to rotate the trimming spindles 515, a vacuum manifold 540 to deliver vacuum to push plates that push the cans forward, and an air manifold 545 to pressurize the cans during trimming. In some embodiments of the trimming invention, the trimming spindles 515 include a shaft mounted to a pair of bearing, a trimmer head 500 (as shown by way of example in FIGS. 1-2*c*), and a pinion gear to rotate the shaft mounted to the precision bearing, the shaft being connected to the trimmer head 500 such that the shaft rotates the trimmer head 500. In some embodiments, the turret 501 is a means for receiving a stress induced plastically deformed container having earing about a respective opening in the container.

Figure 8:
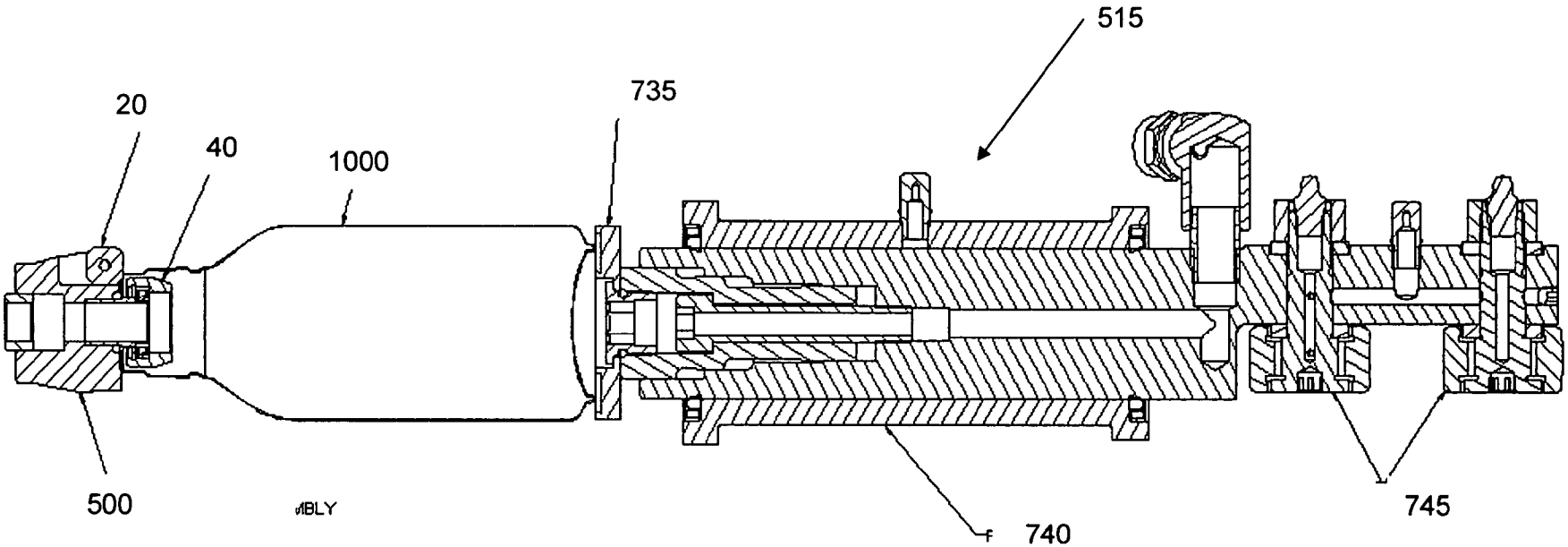
FIG. 8 depicts a spindle assembly according to an embodiment of the present invention.

Referring to FIG. 8, a trimmer spindle assembly 515 is shown, with the trimmer head 500 interfacing with a can 1000 to be trimmed. FIG. 8 also depicts, among other things, cam followers 745.

In some embodiments of the present invention, the trimmer head 500 is constantly spinning/rotating. In some embodiments, trimmer head 500 spins at a relatively high rate of rotational speed, while in other embodiments, the trimmer head rotates at a relatively low speed as compared to the higher speed. In some embodiments of the present invention, the speed of the rotation of the trimmer head 500 may be controlled. In some embodiments, there is a bull gear 535 which may be driven and rotated to adjust the rpm of the trimmer head 500. In some embodiments of the invention, this bull gear may be counter-rotated to increase the rpm speed of the trimmer head. In some embodiments of the trimmer, the speed of the trimmer head 500 is set at a high speed to produce long stringy chips from the trimmed can, while in other embodiments, the speed of the trimmer head is set to a lower speed to produce smaller chips. In some embodiments of the trimmer embodiment, the speed of the trimmer head 500 may be adjusted to control the sizes/shape and/or geometry of the chips that are produced during the trimming operation. That is, in some embodiments of the invention, the speed of the trimmer head 500 may be increased to produce a stringier chip, and in other embodiments the speed may be decreased to produce a less stringy, more discrete sized chips. In some embodiments, the invention includes a feedback loop or the like to identify whether or not the chips are acceptable, and automatically adjusts the speed accordingly. By way of example and not by limitation, the a feedback system may include a video camera or an optical system to determine/estimate the lengths of the chips, which would be in communication with a logic device that would evaluate whether or not the chip size is acceptable/optimal, and output a signal to increase or decrease the speed of the trimmer head accordingly. Again, as noted above in these embodiments, a motor may be utilized, optionally in communication with an automatic feedback system or simply under the control of a user, to control the speed of the bull gear and/or to impart a rotation onto the bull gear to change the rpm of the trimmer head, thus providing the ability to control the type of chips. The trimmer head 500 must rotate to impart a trimming action to the non-rotating can/bottle. The required speed at which the trim head rotates in conjunction with the feed rate of the can/bottle moving into the trim head (generated by the profile of the push cam 530) may vary depending on the chip shape generated by the trimming action. A convenient chip shape would be small curls that can be easily evacuated with a vacuum system as compared to long strings that could catch and tangle. Some variables that dictate the chip shape may be material type and thickness. Thus, some embodiments utilize a variable speed trim head.

Embodiments of the trimmer invention utilizing a bull gear will now be described in more detail.

With respect to FIGS. 3-7, in some embodiments of the present invention, there are multiple of trim heads (not shown) connected to trim spindles 515 that are arrayed around the trimming shaft, and each spindle 515 has a pinion and that pinion (or rotation) gear 516 communicates with the bull gear 535, and the bull gear 535, in some embodiments, is connected to a motor (such as, for example, the motor 550 depicted in FIG. 7, which is connected to the motor by belt 555 via pulley 557), as discussed above, and may be counter-rotated to the direction of the actual shaft to increase the speed on the pinion gears 516. An operator may obtain increased speed of the pinions in this manner, and thus obtain an increase in the speed of the trimmer heads 500. In some embodiments, the bull gear 535 may be also be rotated in the same direction as the shaft. When the bull gear 535 is so rotated (in the same direction as the shaft), and when the bull gear 535 is rotated at the same speed as the shaft, no rotation of the trimmer heads would be obtained. Conversely, if the bull gear 535 was rotated faster than the rotating speed of the shaft, rotation of the heads would be obtained.

Thus, through a combination of varying motor speed and/or varying rotation of the bull gear, the speed of the trimmer head 500 may be controlled. (Again, in some embodiments, a feedback control system may be implemented to vary motor speed/rotation of the bull gear). As just detailed, trimmer head rpm control is useful because of the chip geometry that results from what is cut off the cans. The ability to control the speed of the trimmer head permits a user of the device to experiment with different chips to see which ones are easier to remove (more on this below). Also, it permits the machine to be adjusted to take into account variations in the type of metal (e.g., various types of aluminum may be used in cans) and/or sizes of cans.

In an embodiment of the trimmer invention, the trimmer turret 501 includes a vacuum 560 which helps remove the trimmed material (scrap) from the area of trimming. Particularly, this vacuum utilizes a vacuum manifold and shroud assembly 570 positioned in sufficient close proximity to the area of cutting to vacuum the chips. In further embodiments of the trimmer invention, the interior of the cans are slightly pressurized (for example, through the pilot) so as to decrease the likelihood of chips falling into the can. By way of example only and not by way of limitation, over-pressurization inside the can will "blow" air out of the top of the opening, thus entraining some or all of the chips that have a tendency to fall into the can, and blow those chips outward away from the interior of the can.

As noted above, in some embodiments, the cutter speed may be adjusted. By adjusting the cutter speed, a chip size may be produced that is conducive to being vacuumed up by the vacuum.

The movement of the can with respect to the trimming wheel will now be discussed. According to the teachings above, a vacuum push plate 735 mounted to a push ram 740 holds the can 1000. The can is then introduced at a controlled rate and distance into/towards the rotating trimmer head 500, thus allowing the rotating trimmer head to remove material from the opened edge of the can. In some embodiments of the invention, the trimmer head 500 is held stationary with respect to the axis of rotation, and the can is moved towards the head 500. The can is then retracted from the trimmer head by the vacuum push plate ram.

Given the disclosure of the present invention, one versed in the art would appreciate that there may be other embodiments and modifications within the scope and spirit of the invention. Accordingly, all modifications attainable by one versed in the art from the present disclosure within the scope and spirit of the present invention are to be included as further embodiments of the present invention. The scope of the present invention is to be defined as set forth in the following claims.

What is claimed is:

1. A trimming turret, comprising:

a first trimmer head including a first pilot; and a second trimmer head including a second pilot, wherein the turret is configured to:

receive a stress induced plastically deformed container having an earing about a respective opening in the container; and at least one of (i) direct the container to the first trimmer head so that the pilot becomes located inside the opening of the container, and (ii) direct the first trimmer head to the container so that the pilot becomes located inside the opening of the container, wherein the turret is configured to trim off the earing from the container with the first trimmer head, wherein the first pilot has a first working diameter and the second pilot has a second working diameter that is different than the first working diameter, wherein the first working diameter is sized to pilot into a first sized opening of the container created after a first series of necking operations has been performed on the container, wherein the turret is configured to trim off earing from the container with the first trimmer head after the container has undergone the first series of necking operations while the first pilot is piloted in the first sized opening, wherein the second working diameter is sized to pilot into a second sized opening of the container created after a second series of necking operations has been performed on the container, and wherein the turret is configured to trim off earing from the container with the second trimmer head after the container has undergone the second series of necking operations while the second pilot is piloted into the second sized opening.

2. The turret of claim 1, further comprising:

a third trimmer head including a third pilot having a third working diameter that is substantially the same as the first working diameter; and a fourth trimmer head including a fourth pilot having a fourth working diameter that is substantially the same as the second working diameter, wherein the first, second, third and fourth trimmer heads are arranged in at least one of a clockwise and a counterclockwise manner about a rotation axis of the turret, in the following order: the first trimmer head, the second trimmer head, the third trimmer head and the fourth trimmer head.

3. The turret of claim 1, further comprising a plurality of the first and the second trimmer heads, wherein the first trimmer heads and the second trimmer heads are arranged in a circular manner about a rotation axis of the turret such that the first trimmer heads are interposed between the second trimmer heads.

4. The turret of claim 3, further comprising at least one third trimmer head including a third pilot having a third working diameter that is different than the first and second working diameters, wherein the third trimmer head is interposed between one of the first and second trimmer heads.

5. The turret of claim 1, wherein the turret is configured to hold the container and rotate the first trimmer head to establish a relative rotation between the first trimmer head and the container, and wherein the turret is configured to allow a user to control a rotating speed of the first trimmer head.

6. The turret of claim 5, further comprising:

a bull gear; and a rotation gear mechanically linked to the first trimmer head and in gear communication with the bull gear, wherein relative movement of the rotation gear with respect to the bull gear imparts rotation onto the rotation gear and thus the first trimmer head.

7. The turret of claim 6, wherein the bull gear is configured to rotate, and wherein the turret is configured such that rotation of the bull gear at varying speeds varies the rotation speed of the first trimmer head accordingly.

8. The turret of claim 7, wherein the turret orbits the rotation gear about the bull gear such that meshing of teeth of the rotation gear with teeth of the bull gear imparts rotation onto the first trimmer head.

9. The turret of claim 1, wherein the turret is configured to orbit the first trimmer head about a bull gear to create a relative rotation between the first trimmer head and the container.

10. The turret of claim 8, wherein the orbiting of the rotation gear about the bull gear results from rotation of a shaft, and wherein the bull gear rotates independently of the shaft.

11. The turret of claim 10, wherein the center of rotation of the shaft is coaxial with the center of rotation of the bull gear.

12. The turret of claim 1, wherein the turret is configured to allow the user to adjust the rotating speed of the first trimmer head by rotating a bull gear that is in gear communication with a rotation gear that imparts rotation onto the first trimmer head, wherein the rotation gear orbits about the bull gear such that meshing of gear teeth of the rotation gear with gear teeth of the bull gear create the rotation of the first trimmer head, wherein the turret is configured to rotate the bull gear in a direction counter to a direction of orbit of the rotation gear, such that the speed of rotation of the rotation gear is higher as compared to when the rotation gear is orbiting about the bull gear when the bull gear is not rotating.

13. The turret of claim 7, further including a device configured to at least one of impart rotation onto the bull gear and control the imparted rotation of the bull gear.

14. The turret of claim 13, wherein the device configured to at least one of impart rotation onto the bull gear and control the imparted rotation of the bull gear is a motor that is in rotational communication with the bull gear.

15. A can forming device, comprising:

the turret of claim 1; and a recirculation device configured to recirculate the container after it has been trimmed by the first trimmer head back into the turret to be trimmed a second time by the second trimmer head and not by the first trimmer head.

16. A can forming device, comprising:

the turret of claim 3; and a recirculation device configured to recirculate the container after it has been trimmed by one of the first trimmer heads back into the turret to be trimmed a second time by one of the second trimmer heads and not by one of the first trimmer heads.

17. A can forming device comprising, the turret of claim 1; and a pressurization device configured to increase air pressure in an interior of the container relative to ambient air pressure.

18. The turret of claim 1, wherein the container is an aluminum can.

19. A trimming turret, comprising:

a plurality of first trimmer heads each including a pilot; and a plurality of second trimmer heads each including a pilot, wherein the turret is configured to:

receive a stress induced plastically deformed container having an earing about a respective opening in the container; and at least one of (i) direct the container to the first trimmer head so that the pilot becomes located inside the opening of the container, and (ii) direct the first trimmer head to the container so that the pilot becomes located inside the opening of the container, wherein the turret is configured to trim off the earing from the container with the first trimmer head, wherein the second trimmer heads have pilots of different working diameters than the pilots of the first trimmer heads, wherein the turret is configured to hold a plurality of respective containers and rotate the respective first trimmer heads and second trimmer heads to establish a relative rotation between the respective trimmer heads and the respective containers during trimming of the containers, and wherein the turret is configured to allow a user to control a rotating speed of the trimmer heads.

20. The turret of claim 19, further comprising:

a bull gear; and a plurality of rotation gears mechanically linked to respective first trimmer heads and second trimmer heads and in gear communication with the bull gear, wherein relative movement of the rotation gears with respect to the bull gear imparts rotation onto the rotation gears and thus the trimmer heads.

21. The turret of claim 20, wherein the bull gear is configured to rotate, and wherein rotation of the bull gear at varying speeds varies the rotation speed of the trimmer heads accordingly.

22. A can forming device comprising, the turret of claim 19; and a recirculation device configured to recirculate the container after it has been trimmed by the turret back into the turret to be trimmed a second time.

23. The turret of claim 19, wherein all blades of each of the first trimmer heads are positioned external to the container having the earing.

24. The turret of claim 19, wherein each first trimming head with the at least one blade is configured to rotate.

* * * * *